US005549535A

United States Patent [19]

Wang et al.

[11] Patent Number: 5,549,535

[45] Date of Patent: Aug. 27, 1996

[54] BODY BUILDING STATION

[75] Inventors: Leao Wang; Peter Wu, both of Taichung Hsien, Taiwan

[73] Assignee: Greenmaster Industrial Corp., Taichung, Taiwan

[21] Appl. No.: 394,948

[22] Filed: Feb. 27, 1995

[51] Int. Cl.[6] ..... A63B 21/04

[52] U.S. Cl. ..... 482/138; 482/130; 482/136; 482/907

[58] Field of Search ..... 482/121–123, 482/92, 126, 127, 129, 130, 133, 135–138, 142, 145, 907; 601/35; 297/411.31, 411.38, 423.37

[56] References Cited

U.S. PATENT DOCUMENTS

| | | | |
|---|---|---|---|
| 4,478,411 | 10/1984 | Baldwin | 482/100 |
| 5,094,449 | 3/1992 | Stearns | 482/130 |
| 5,277,681 | 1/1994 | Holt | 482/138 |
| 5,324,247 | 6/1994 | Lepley | 482/136 |
| 5,393,286 | 2/1995 | Cheng | 482/130 |
| 5,435,801 | 7/1995 | Hung | 482/130 |

FOREIGN PATENT DOCUMENTS

| | | | |
|---|---|---|---|
| 3408036 | 9/1985 | Germany | 482/130 |

*Primary Examiner*—Richard J. Apley
*Assistant Examiner*—Victor K. Hwang
*Attorney, Agent, or Firm*—Beveridge, DeGrandi, Weilacher & Young, L.L.P.

[57] ABSTRACT

A body building station includes three juxtaposed posts extending downwardly from the underside of a securing seat of a seat of a frame. The side posts are pivotally connected to two rocker arms along the front side of the frame to form a leg exercising mechanism, while the central post is pivotally connected to a rotary frame at the rear side of the frame to form a twisting mechanism. Both tips of the rotary frame are connected to a bent press bar to form an abdominal exercising mechanism. Rubber resistance elements may be selectively positioned at suitable locations of the frame to facilitate the carrying out of different exercises.

8 Claims, 6 Drawing Sheets

BODY BUILDING STATION

BACKGROUND OF THE INVENTION (a) Technical Field

The present invention relates generally to a body building station, and more particularly to an exercising apparatus for exercising the muscles of the thighs, waist, and abdomen.

(b) Description of the Prior Art

Conventionally, a leg exercising apparatus and an abdominal exercising apparatus are two separate machines. If one wants to exercise his leg as well as his abdominal muscles, one needs to buy two machines, which will then occupy much space. Regarding the known abdominal exercising apparatus, a typical one is shown in FIG. 1, and which mainly comprises a rotary seat 20. The user simply sits on the seat 20 and twists his waist left and right while his legs are lifted above the ground. In this kind of exercising apparatus, the seat 20 moves without being subjected to external resistance. Hence, the exercising effects are no better than when the user simply twists his body while standing or sitting; an office chair may also provide the same exercising effects as such an apparatus. This structural design is therefore devoid of any meritorious features. As for the abdominal exercising mechanism of this kind of exercising apparatus, a U-shaped bar 22 is provided under the seat 20 with the two arms thereof arranged at both sides of the seat 20, and the tips of the two arms of the U-shaped bar 22 are each pivotally connected to a bent press bar 24 having a grip portion 26. By means of a back rest 28 and the grip portions 26, the user may press forward or lean backward to train his abdominal muscles. But because the only source of resistance is supplied by a twisted type rubber resistance element 21 installed at one side of the exercising apparatus, there is the drawback that the resistance is not uniformly distributed, and this affects the overall exercising effects.

As for the conventional leg exercising apparatus, a typical one is shown in FIG. 2. The leg exercising apparatus shown mainly comprises a pair of curved arms 11 connected to a bottom side of a seat 10. A first pair of posts 13 and a second pair of posts 14 are respectively located at the middle and rear sections of a body 12. When the user wants to train his leg muscles by doing leg stretching exercises, rubber resistance elements 15 are respectively fitted onto a third post 16 and the second pair of posts 14 at the middle section of the body 12, thereby the two curved arms 11 are moved to the front of the seat 10 while maintaining a suitable space therebetween. The user may then sit on the seat 10, with the legs put in the space in front and straddling over two supporting arms 17 which are pushed outward in exercising. When the user wants to train his leg muscles by doing leg gripping exercises, the resistance elements 15 are inserted onto the third posts 16 and the first posts 13 at the rear section of the body 12. Due to the resistance of the rubber resistance elements 15, the curved arms 11 are arranged at both sides of the seat 10. The user then sits on the seat 10 and stretches both legs beyond the supporting arms 17 and straddles thereon to push the supporting arms 17 inwardly.

Although the structure of this conventional leg exercising apparatus is simple and easy to use, when the user exercises his leg muscles by doing scissors actions, the legs must be straight and parallel to the ground in order to proceed with the desired exercises. However, as is well known, when the user is in such a posture, his hip muscles, leg muscles and shin muscles must be in a tense state for a long time so that the sitting posture may be maintained. Although there are provided supporting arms 17 for helping to support the thighs, he still has to try to support the weight of the shins. This posture results in extremely unnatural movements of the shins, so that the user feels very exhausted within a very short time. In particular, the lower part of the body and the waist suffers intense soreness. In other words, it is not easy to keep the legs horizontal to the ground in exercising, especially when the user has to further push the supporting arms inwardly or outwardly. Evidently, this leg exercising apparatus is devoid of practical value.

SUMMARY OF THE INVENTION

A primary object of the present invention is to provide a body building station for exercising the muscles of the legs, waist, and abdomen, wherein right-angled pads, the angles thereof being changeable, are provided at an end of two rocker arms, and the user may rest his legs on horizontal portions of the pads while exerting forces on vertical portions of the pads; rubber resistance elements are provided at the lower side of a rotary frame to provide resistance while the user is twisting, and rubber resistance elements are provided at either sides of a press bar to provide balanced resistance when the user exercises his abdominal muscles.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
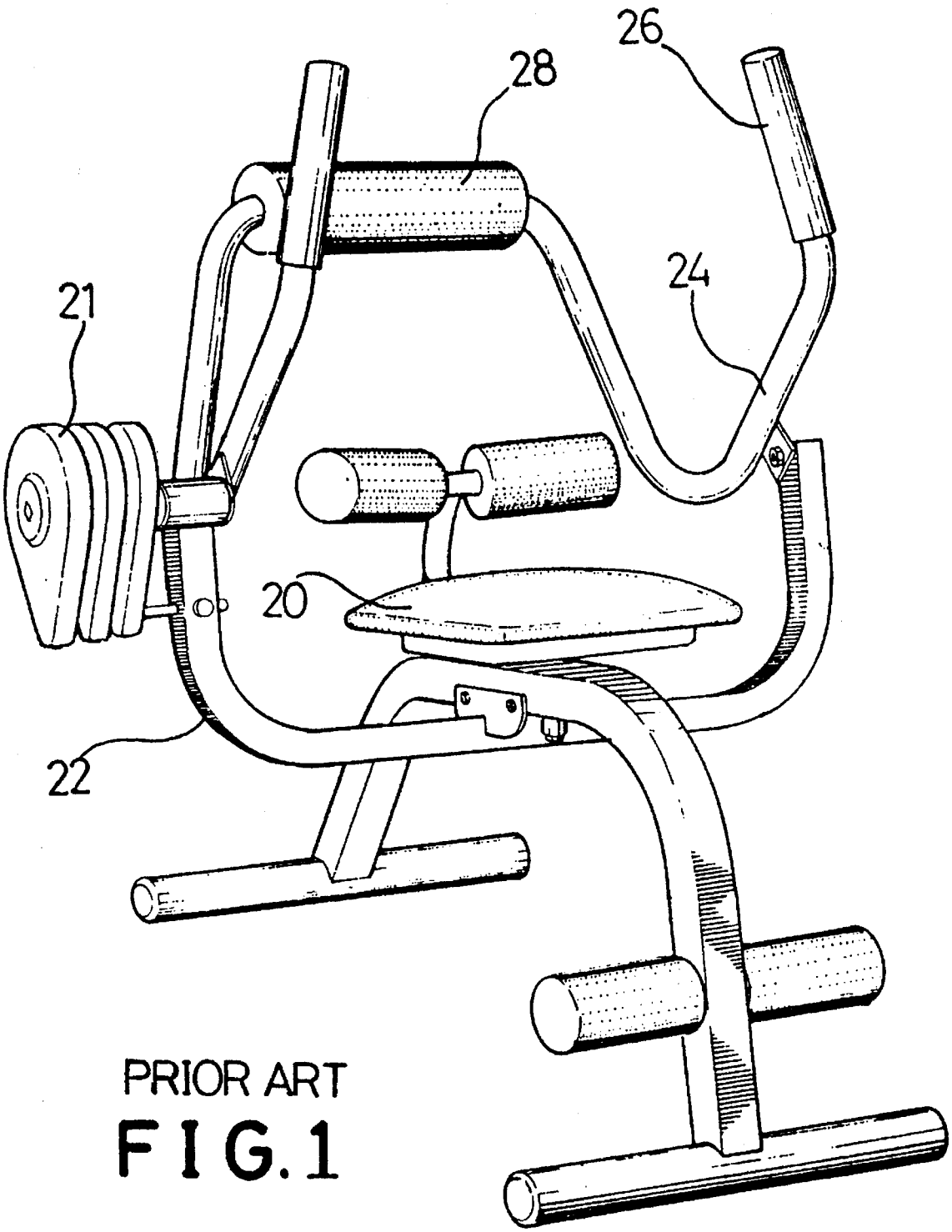
PRIOR ART FIG. 1
FIG. 1 is a perspective view of the conventional abdominal exercising apparatus.
Figure 2:
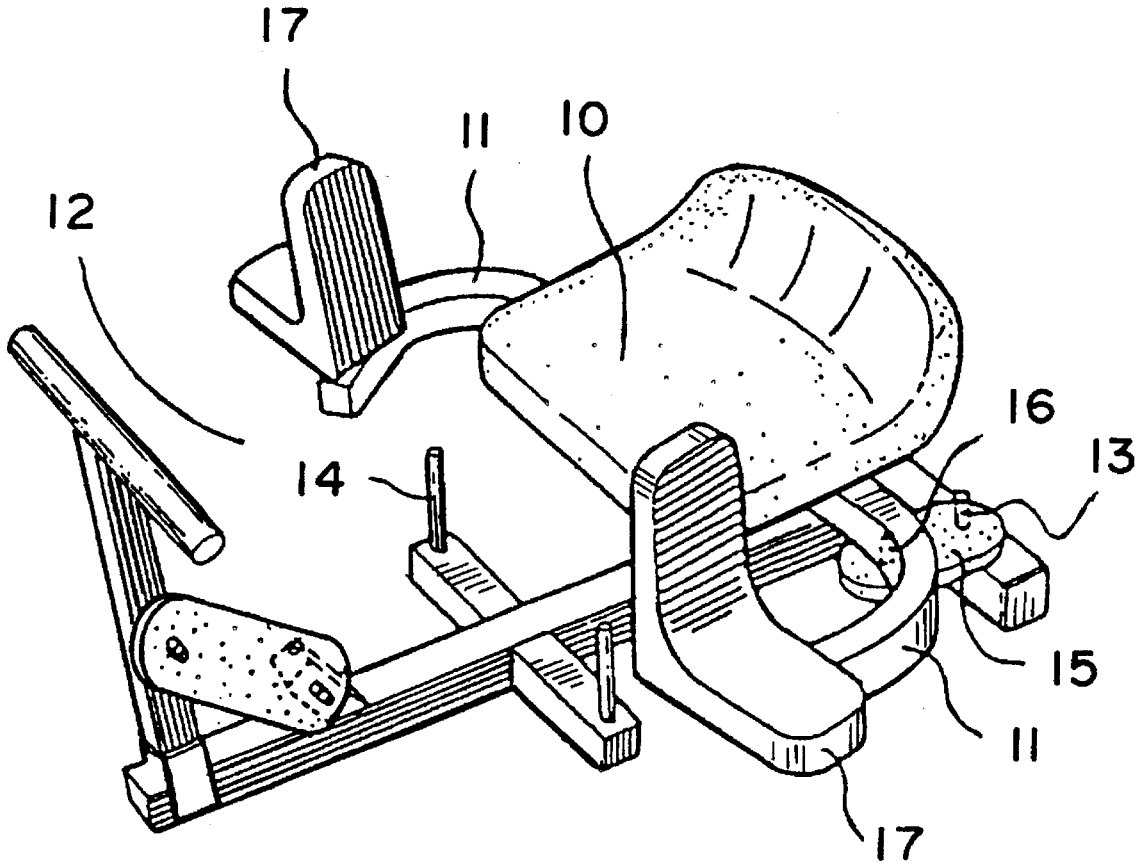
PRIOR ART FIG. 2
FIG. 2 is a perspective view of the conventional leg exercising apparatus.
Figure 3:
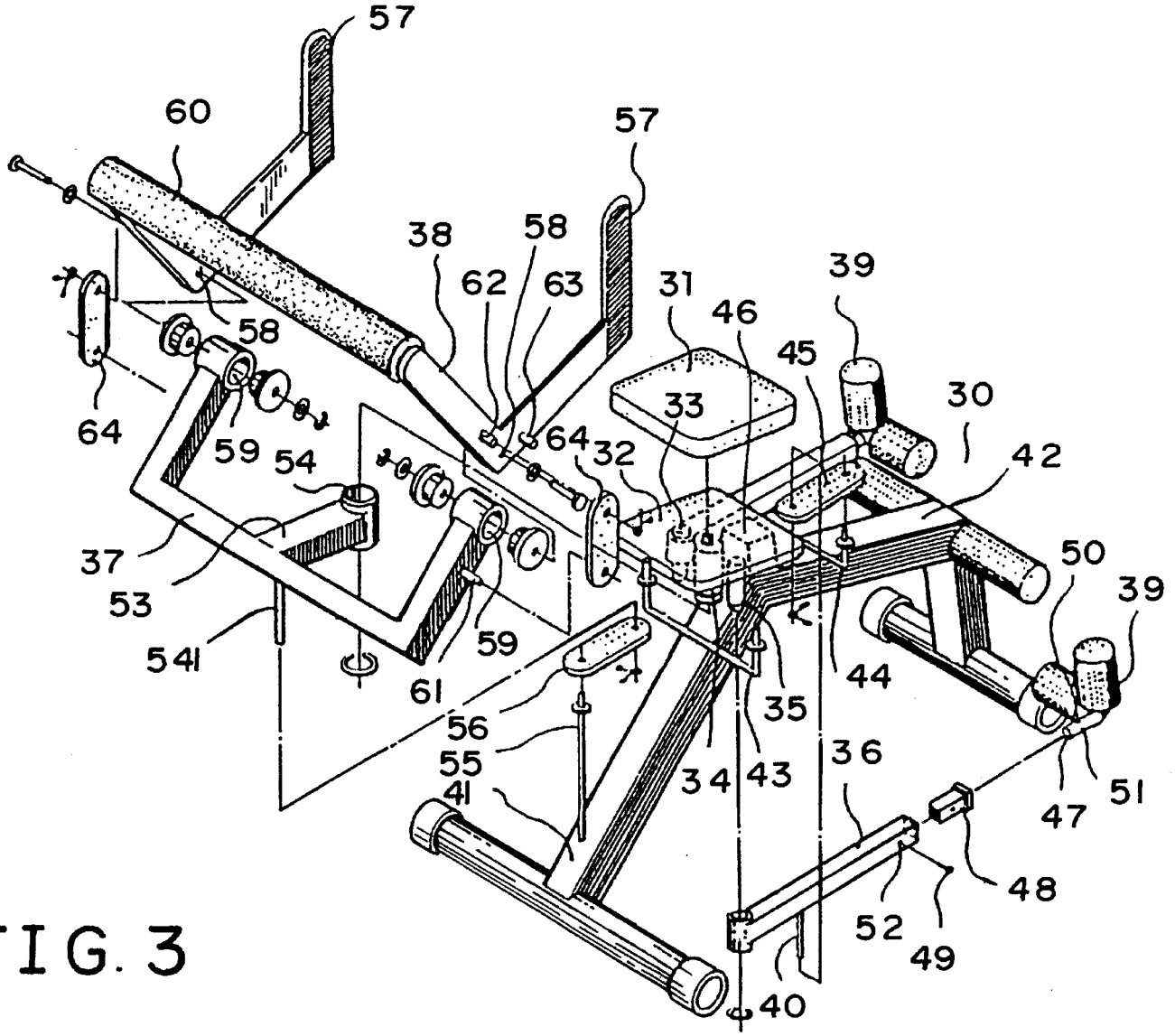
FIG. 3 is a partially exploded view of the present invention.
Figure 4:
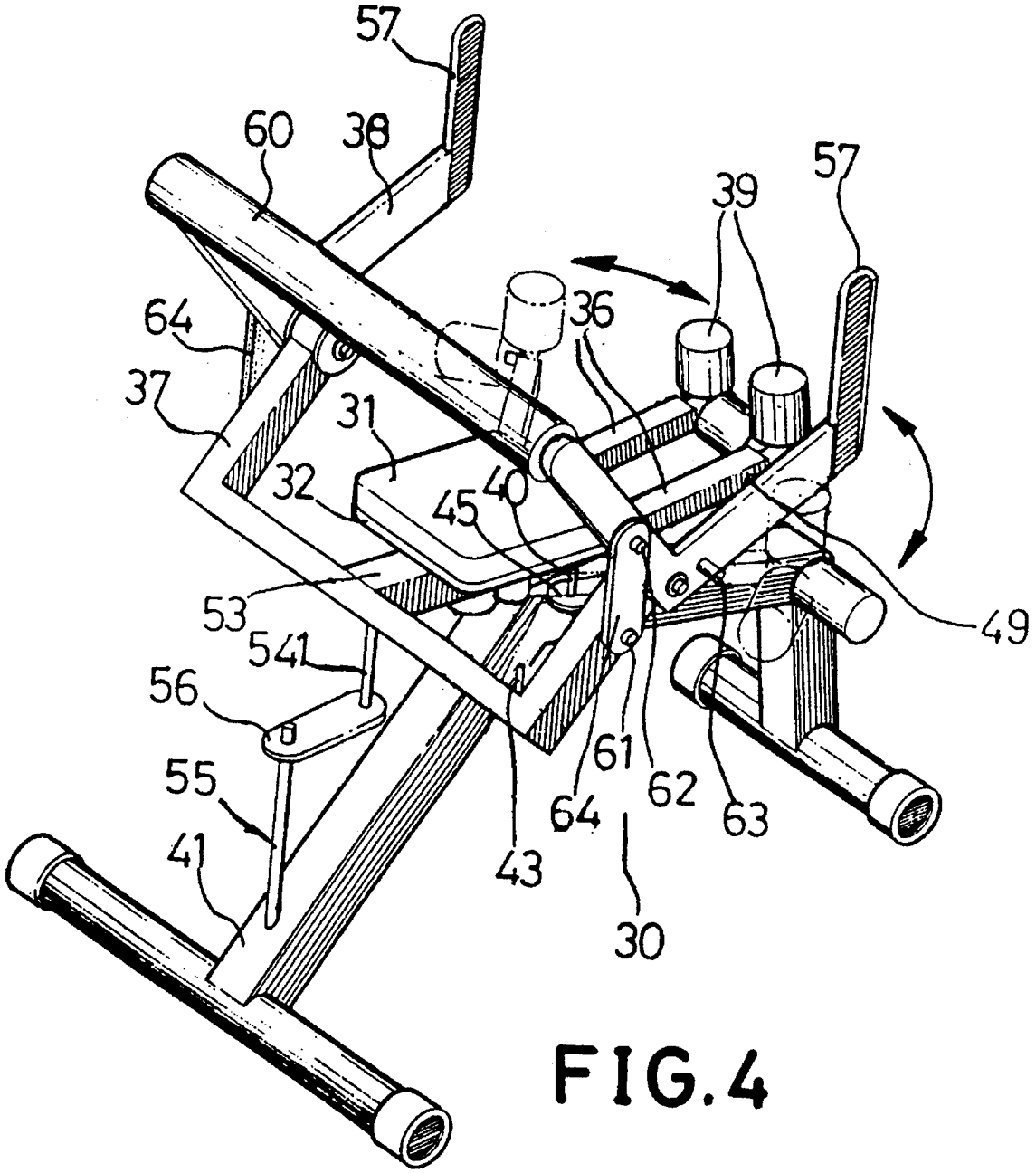
FIG. 4 is a perspective view of the present invention, showing the positions of the leg exercising mechanism in scissors actions.

As shown in FIGS. 3 and 4, the present invention mainly comprises a frame 30, a seat 31, a securing seat 32 and three juxtaposed posts 33, 34 and 35 respectively extended downwardly from the underside of the securing seat 32. The posts 33 and 35 which are at the sides are pivotally connected to two rocker arms 36 along the front side of the frame 30 to form a leg exercising mechanism. The post 34 in the center is pivotally connected to a rotary frame 37 (see FIGS. 5 and 6) to the rear side of the frame 30 to form a twisting mechanism; the two ends of the rotary frame 37 are respectively pivotally connected to a bent press bar 38 to form an abdominal exercising mechanism.

The leg exercising mechanism includes the two rocker arms 36 and right-angled pads 39 inserted on one end of the rocker arms 36. The bottom end of each rocker arm 36 is provided with a rod 40. A first post 43 extends from a top end of rear inclined support bar 41 of the frame 30, and a second post 44 extends from a central section of a front inclined support bar 42 of the frame 30. The rubber resistance elements are arranged on posts 43 or 44, depending on the type of exercise the user wants to do. As shown in FIG. 4, when the user wants to do leg stretching exercises, a rubber resistance element 45 having two through holes is inserted onto the rod 40 and the second post 44. The two rocker arms 36 will then be located on either side of a middle post 46 of the frame 30. The user may then straddle his legs on the horizontal portions of the respective right-angled pads 39 with the vertical portions of the pads 39 on the outside. On the contrary, if the user wants to perform leg gripping exercises, the rubber resistance element 45 is inserted onto the rod 40 and the first post 43, and the two rocker arms 36 will extend on either side of the frame 30 due to the position of the first post 43. The user may then straddle his legs on the horizontal portions of the respective right-angled pads 39 with the vertical portion thereof gripped between the legs.

Each right-angled pad 39 is connected to the corresponding rocker arm 36 by means of an extended portion 47 thereof being fitted into a sleeve 48 which is inserted into an inner hole of the rocker arm 36. A pin 49 is then passed into a corresponding hole of the rocker arm 36 to secure the sleeve 48 within the rocker arm 36. The extended portion 47 of the right-angled pad 39 is provided with a longitudinal through hole 50 and a lateral through hole 51 at appropriate positions. A lateral through hole 52 is also provided in each rocker arm 36, so that when the user wants to change the angle of the pads 39, he only needs to take out the pin 49 and turn the pads 39 to a desired position or angle and insert the pin 49 back into its place. The pin 49 will pass through the longitudinal through hole 50 or the lateral through hole 51 of the extended portion 47, depending on the relative position of the rocker arm 36 and the pad 39, achieving the purpose of securing the pads 39 in place.

Figure 5:
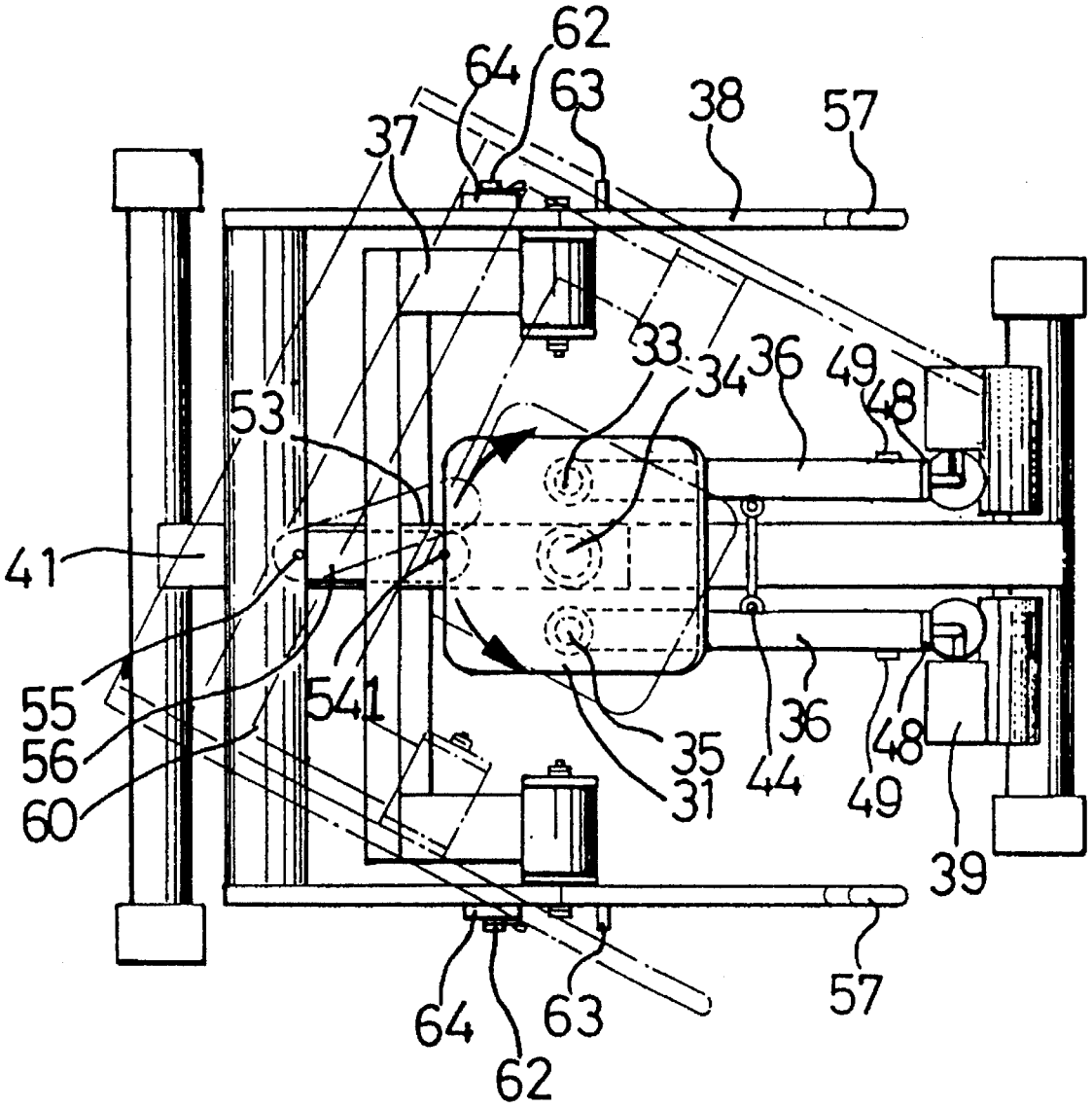
FIG. 5 is a top view of the present invention, showing the action of the rotary frame.

Referring also to FIG. 5, the twisting mechanism includes the rotary frame 37 and the rotary seat 31 which is capable of pivotal rotation. The rotary frame 37 is substantially a U-shaped frame structure and has a positioning bar 53 inclining forwardly from a middle section thereof. By means of a hole 54 in the other end of the positioning bar 53, the rotary frame 37 is pivotally connected to the post 34 at the underside of the securing seat 32 of the frame 30. A rod 541 is provided at an appropriate position of the underside of the positioning bar 53 for matching the third post 55 located at a comparatively lower end of the rear inclined support bar 41 of the frame 30. A rubber resistance element 56 having two corresponding through holes is fitted onto the rod 541 and the third post 55. By means of the press bars 38 pivotally provided at either end of the rotary frame 37, the user may straddle his legs on the horizontal portions of the right-angled pads 39 and hold grip portions 57 of the press bars 38 with both hands while twisting his body. As mentioned above, the seat 31 may pivotally rotate to match the twisting movement, and the resistance element 56 will also provide a suitable resistance to achieve excellent exercising effects.

Figure 6:
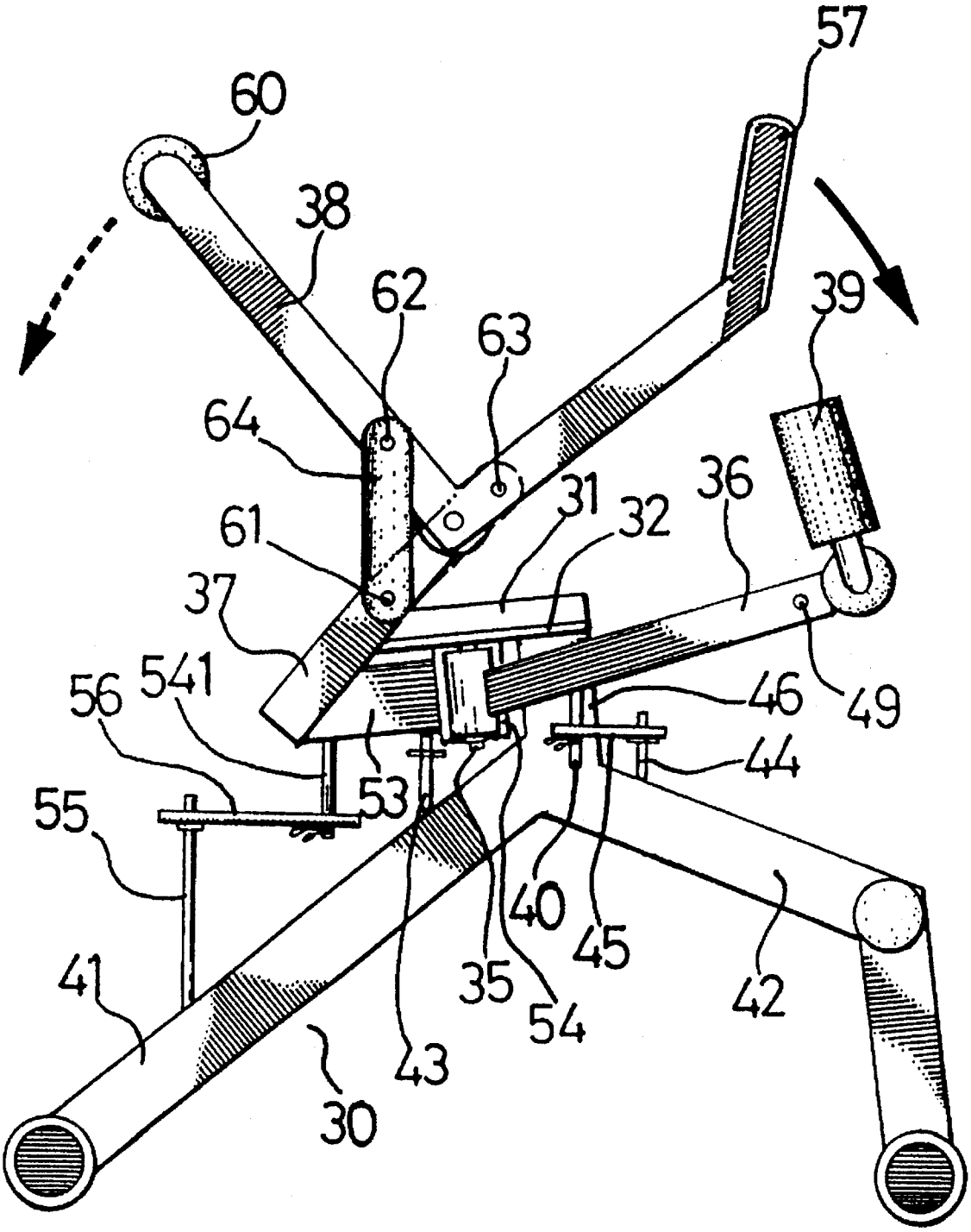
FIG. 6 is a side view of the present invention, showing the action of the press bar.

With reference also to FIG. 6, the abdominal exercising mechanism includes the bent press bars 38 pivotally connected to either end of the rotary frame 37. The press bar 38 is in the shape of a "U" when viewed from the top, but it becomes a slightly "V" shape when viewed from the side. This is chiefly because the bent section of the press bar 38 is provided with a hole 58 for pivotal connection with a corresponding hole 59 in either tip of the rotary frame 37. The front section of the press bar 38 is the grip portion 57 which bends upwardly, and the rear section thereof is covered with foam rubber 60 to serve as the back rest.

When the user wants to do abdominal forward pressing exercises, rubber resistance elements 64 are respectively fitted onto rods 61 disposed at the outer side of the upper ends of the rotary frame 37 and the fourth posts 62 of the press bars 38. When the user wants to do backward pressing exercises, the weights are fitted onto the rods 61 and the fifth posts 63 of the press bars 38.

By means of employing the above-described mechanisms in cooperation with means for providing resistance (i.e., rubber resistance elements) arranged at suitable positions, the user needs only to alter the position of the resistance elements in order to perform various kinds of exercises. Besides, different rubber resistance elements may be used as desired to provide the desired resistance in exercising.

Although the present invention has been illustrated and described with reference to the preferred embodiment thereof, it should be understood that it is in no way limited to the details of such embodiment, but numerous modifications are possible within the scope of the appended claims.

What is claimed is:

1. A body building station, comprising:

a frame including a first support bar having a first support bar post extending therefrom;

a securing seat mounted to the frame;

a first post, a second post and a third post, wherein each of these posts extends from a first face of the securing seat, wherein the first post is arranged toward a first side of the securing seat, the second post is arranged toward a second side of the securing seat, and the third post is arranged at a central area of the first face of the securing seat;

a first rocker arm pivotally connected to the first post;

a second rocker arm pivotally connected to the second post;

a rotary frame pivotally connected to the third post to form a twisting mechanism, and wherein the rotary frame is pivotally connected to a press bar to form an abdominal exercising mechanism, the rotary frame having a positioning bar extending from a middle section thereof, the positioning bar having a hole defined therethrough for pivotal connection with the third post of the securing seat, the positioning bar being provided with a first rod extending therefrom, and wherein a first resistance element connects the first rod of the positioning bar and the first support bar post.

2. A body building station as claimed in claim 1, wherein a first end of the first rocker arm has a right-angled pad, and a first end of the second rocker arm includes a right-angled pad, wherein a second end of the first rocker arm includes a second rod extending therefrom, and a second end of the second rocker arm includes a third rod extending therefrom, wherein the second rod is connected with a fourth post which extends from a second support bar of the frame by a second resistance element, and the third rod is connected with a fifth post which extends from the second support bar of the frame by a third resistance element.

3. A body building station, comprising:

a frame including a first support bar;

a securing seat mounted to the frame;

a first post, a second post and a third post, wherein each of these posts extends from a first face of the securing seat, wherein the first post is arranged toward a first side of the securing seat, the second post is arranged toward a second side of the securing seat, and the third post is arranged at a central area of the first face of the securing seat;

a first rocker arm pivotally connected to the first post;

a second rocker arm pivotally connected to the second post;

a rotary frame pivotally connected to the third post to form a twisting mechanism, and wherein the rotary frame is pivotally connected to a press bar to form an abdominal exercising mechanism, wherein the rotary frame has a first rod provided at a first end thereof and a second rod provided at a second end thereof, wherein the press bar includes a first section provided with a first hole for pivotal connection with a second hole defined in the rotary frame, and a second section provided with a third hole for pivotal connection with a fourth hole defined in the rotary frame, wherein a front section of the press bar provides a grip portion, and a rear section of the press bar provides a back rest, wherein a first resistance element connects the first rod of the rotary frame with a fourth post provided on the first section of the press bar, and a second resistance element connects the second rod of the rotary frame with a fifth post provided on the second section of the rotary frame.

4. A body building station as claimed in claim 3, wherein a first end of the first rocker arm has a right-angled pad, and a first end of the second rocker arm includes a right-angled pad, wherein a second end of the first rocker arm includes a third rod extending therefrom, and a second end of the second rocker arm includes a fourth rod extending therefrom, wherein the third rod is connected with a sixth post which extends from a second support bar of the frame by a third resistance element, and the fourth rod is connected with a seventh post which extends from the second support bar of the frame by a fourth resistance element.

5. A body building station, comprising:

a frame;

a securing seat mounted to the frame;

a seat connected to the securing seat; and three juxtaposed posts extending downwardly from an underside of said securing seat, wherein two of said posts are arranged toward opposing sides of the securing seat and are pivotally connected to two rocker arms along a front side of said frame, and the remaining post is located at a central area of the securing seat and is pivotally connected to a rotary frame at a rear side of said frame to form a twisting mechanism, wherein two tips of said rotary frame are pivotally connected to a bent press bar to form an abdominal exercising mechanism, wherein said twisting mechanism consists of said rotary frame and said seat which is pivotally rotatable, said rotary frame being a substantially U-shaped structure and having a positioning bar extending forwardly from a middle section thereof, said positioning bar having a hole defined in an end thereof for pivotal connection with the post located at the central area of the underside of said securing seat, said positioning bar being provided with a rod extending from a bottom end thereof and cooperating with a fourth post located at a lower side of a rear inclined support bar of said frame for insertion thereonto a rubber resistance element.

6. A body building station as claimed in claim 5, further comprising a leg exercising mechanism which consists of said two rocker arms and right-angled pads inserted onto an end of each rocker arm, wherein a bottom end of each rocker arm has a rocker arm rod provided thereon, said rocker arm rods cooperating with a fifth post and a sixth post extending from a middle section of a front inclined support bar of said frame for insertion thereonto resistance elements.

7. A body building station, comprising:

a frame;

a securing seat mounted to the frame;

a seat connected to the securing seat; and three juxtaposed posts extending downwardly from an underside of said securing seat, wherein two of said posts are arranged toward opposing sides of the securing seat and are pivotally connected to two rocker arms along a front side of said frame, and the remaining post is located at a central area of the securing seat and is pivotally connected to a rotary frame at a rear side of said frame to form a twisting mechanism, wherein two tips of said rotary frame are pivotally connected to a bent press bar to form an abdominal exercising mechanism, wherein said abdominal exercising mechanism consists of said press bar pivotally connected to the two tips of said rotary frame, said press bar being substantially U-shaped when viewed from above and substantially V-shaped when viewed from a side, said press bar having bent sections which are provided with holes for pivotal connection with holes in the two tips of said rotary frame, a front section of said press bar being an upwardly bent grip portion, and a rear section thereof being wrapped with foam rubber to form a back rest, and wherein rubber resistance elements are inserted onto rods each being disposed at an outer side of an upper end of said rotary frame and a fourth post and a fifth post respectively provided near said bent portions of said press bar.

8. A body building station as claimed in claim 7, further comprising a leg exercising mechanism which consists of the two rocker arms and right-angled pads inserted onto an end of each rocker arm, wherein a bottom end of each rocker arm has a rocker arm rod provided thereon, the rocker arm rods cooperating with a sixth post and a seventh post extending from a middle section of a front inclined support bar of the frame for insertion thereonto resistance elements.

* * * * *